US010276943B2

(12) United States Patent
Kawahata et al.

(10) Patent No.: US 10,276,943 B2
(45) Date of Patent: Apr. 30, 2019

(54) ANTENNA DEVICE INCLUDING PATCH ARRAY ANTENNA AND CONDUCTIVE METAL MEMBER

(71) Applicant: Murata Manufacturing Co., Ltd., Kyoto (JP)

(72) Inventors: Kazunari Kawahata, Kyoto (JP); Ryuken Mizunuma, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 15/703,267

(22) Filed: Sep. 13, 2017

(65) Prior Publication Data

US 2018/0076530 A1 Mar. 15, 2018

(30) Foreign Application Priority Data

Sep. 14, 2016 (JP) ..... 2016-179318

(51) Int. Cl.

| | |
|---|---|
| ***H01Q 13/28*** | (2006.01) |
| ***H01Q 21/06*** | (2006.01) |
| ***H01Q 1/48*** | (2006.01) |
| ***H01Q 9/04*** | (2006.01) |
| ***H01Q 19/10*** | (2006.01) |
| ***H01Q 21/08*** | (2006.01) |

(52) U.S. Cl.

CPC ..... *H01Q 13/28* (2013.01); *H01Q 1/48* (2013.01); *H01Q 9/0407* (2013.01); *H01Q 19/10* (2013.01); *H01Q 21/065* (2013.01); *H01Q 21/08* (2013.01)

(58) Field of Classification Search

CPC ..... H01Q 1/48; H01Q 13/28; H01Q 9/0407; H01Q 21/065; H01Q 21/08

USPC ..... 343/789

See application file for complete search history.

(56) References Cited

U.S. PATENT DOCUMENTS

| | | | | |
|---|---|---|---|---|
| 7,215,298 | B1 * | 5/2007 | Fraschilla | H01Q 1/08 342/174 |
| 2008/0054317 | A1 * | 3/2008 | Kim | H01L 27/14621 257/290 |
| 2008/0136713 | A1 * | 6/2008 | Fu | H01Q 21/065 343/700 MS |
| 2009/0213012 | A1 * | 8/2009 | Jiang | H01Q 1/38 343/700 MS |
| 2014/0225782 | A1 * | 8/2014 | Sanford | H01Q 21/0087 343/700 MS |

(Continued)

FOREIGN PATENT DOCUMENTS

| | | | |
|---|---|---|---|
| JP | H07-273536 | A | 10/1995 |
| JP | 2010-161612 | A | 7/2010 |
| WO | 00/48269 | A1 | 8/2000 |

*Primary Examiner* — Lam T Mai

(74) *Attorney, Agent, or Firm* — Pearne & Gordon LLP

(57) ABSTRACT

A patch array antenna includes a ground plane and a plurality of radiation elements that are disposed being distanced from the ground plane. A conductive metal member is disposed above a surface on which the plurality of radiation elements are disposed. The metal member overlaps with part of a region of each of the plurality of radiation elements in a direction orthogonal to an array direction of the patch array antenna and does not overlap with the other part of the region, and continuously extends from the radiation element at one end to the radiation element at the other end in the array direction.

12 Claims, 6 Drawing Sheets

(56) References Cited

U.S. PATENT DOCUMENTS

2014/0333502 A1* 11/2014 Uno ..... H01Q 21/08
343/844
2017/0365935 A1* 12/2017 Kashino ..... H01Q 21/22

* cited by examiner

ANTENNA DEVICE INCLUDING PATCH ARRAY ANTENNA AND CONDUCTIVE METAL MEMBER

This application claims priority from Japanese Patent Application No. 2016-179318 filed on Sep. 14, 2016. The content of this application is incorporated herein by reference in its entirety.

BACKGROUND

The present disclosure relates to antenna devices. Japanese Unexamined Patent Application Publication No. 2010-161612 discloses a directivity-variable antenna device capable of changing the directivity even in the case of being surrounded by a metal housing. Part of the metal housing of a wireless communication apparatus is cut out, and the antenna device including a variable directivity antenna and a plurality of waveguides is mounted in the cutout section. The stated antenna device includes the waveguides having mutually different opening widths, a waveguide connection portion connecting the waveguides at one ends thereof, and the variable directivity antenna provided in the waveguide connection portion. Radio waves are propagated to one of the two waveguides by switching the directivity of the variable directivity antenna.

In Japanese Unexamined Patent Application Publication No. 2010-161612, an example in which the antenna device including the waveguides is mounted inside the metal housing of the stationary-type apparatus is described. However, because circuit components are mounted in high density inside a metal housing of a mobile terminal such as a smart phone or the like, it is difficult to mount an antenna device including a waveguide inside the metal housing. In particular, it is difficult to mount a waveguide so that radio waves are guided in a thickness direction of a thinned metal housing.

Further, it is difficult in some case to provide a large cavity in a metal housing so as to radiate radio waves from the standpoint of design or strength.

BRIEF SUMMARY

The present disclosure provides an antenna device capable of radiating radio waves even if the cavity is small.

An antenna device according to a first aspect of the present disclosure includes a patch array antenna having a ground plane and a plurality of radiation elements that are disposed being distanced from the ground plane, and a conductive metal member that is disposed above a surface on which the plurality of radiation elements are disposed, overlaps with part of a region of each of the plurality of radiation elements in a direction orthogonal to an array direction (a direction in which the plurality of radiation elements are aligned) of the patch array antenna and does not overlap with the other part of the region, and continuously extends from the radiation element at one end to the radiation element at the other end in the array direction.

Because the metal member covers part of the region of the radiation element, it is sufficient that a cavity is secured only above part of the region of the radiation element. This makes it possible to miniaturize the cavity. A current is excited in the metal member by a fringing electric field from the radiation element. An edge of the metal member functions as a wave source in accordance with distribution of the excited current. Adjusting the distribution of the current excited in the metal member makes it possible to adjust directivity characteristics of the antenna device.

The antenna device according to a second aspect of the present disclosure is configured such that, in addition to the configuration of the antenna device according to the first aspect, a dimension of the region of each of the plurality of radiation elements overlapping with the metal member is no more than about half a dimension of the radiation element in the direction orthogonal to the array direction.

With this, a decrease in gain of the antenna device can be suppressed.

The antenna device according to a third aspect of the present disclosure is configured such that, in addition to the configuration of the antenna device according to the first or second aspect, an interval between the radiation element and the metal member is no less than about 1/50 and no more than about 1/10 of a free space wave length that corresponds to a resonant frequency of the patch array antenna.

With this, degradation in characteristics of the antenna device can be suppressed and an effect brought by disposing the metal member can be satisfactorily obtained.

The antenna device according to a fourth aspect of the present disclosure further includes, in addition to the configuration of the antenna device according to any one of the first through third aspects, a feed line having a microstrip line structure to feed power to the plurality of radiation elements, and the stated feed line overlaps with the above-mentioned metal member and is disposed between the ground plane and the metal member.

As such, a transmission line of a tri-plate structure is formed by the feed line, the ground plane, and the metal member. As a result, radiation from the feed line can be reduced.

The antenna device according to a fifth aspect of the present disclosure further includes, in addition to the configuration of the antenna device according to any one of the first through fourth aspects, a housing that is partially formed of metal and accommodates the patch array antenna, and the above-mentioned metal member configures part of the housing.

With this, the cavity in the metal portion of the housing can be made small in size.

The antenna device according to a sixth aspect of the present disclosure is configured such that, in addition to the configuration of the antenna device according to the fifth aspect, the plurality of radiation elements are disposed inside the housing along an end of the housing.

Disposing the antenna device close to an edge of the housing makes it possible to enhance efficiency of space usage inside the housing.

Because the metal member covers part of a region of the radiation element, it is sufficient that a cavity is secured only above part of the region of the radiation element. This makes it possible to make the cavity small in size. A current is excited in the metal member by a fringing electric field from the radiation element. An edge of the metal member functions as a wave source in accordance with distribution of the excited current. Adjusting the distribution of the current excited in the metal member makes it possible to adjust the directivity characteristics of the antenna device.

Other features, elements, and characteristics of the present disclosure will become more apparent from the following detailed description of embodiments of the present disclosure with reference to the attached drawings.

DETAILED DESCRIPTION

An antenna device according to a first embodiment will be described with reference to FIGS. 1A and 1B.

Figure 1A:
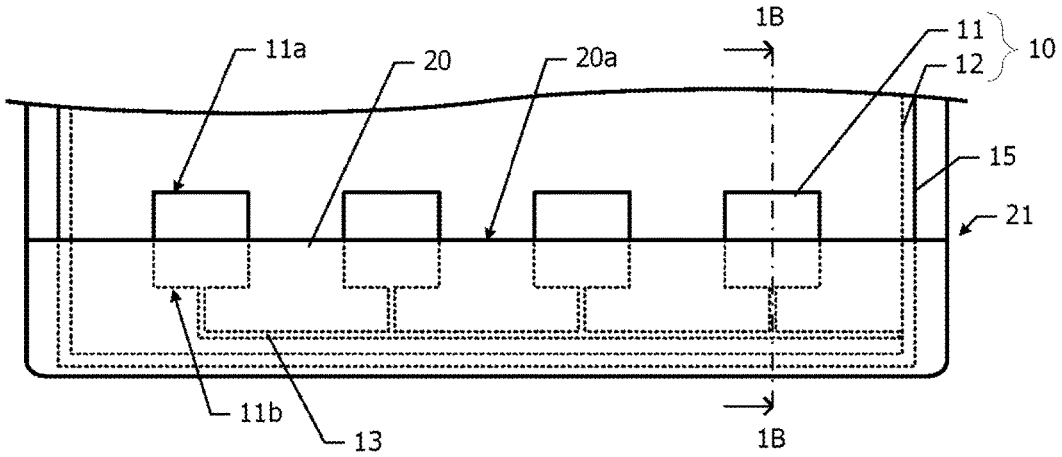
FIG. 1A is a plan view of an antenna device according to a first embodiment.
Figure 1B:
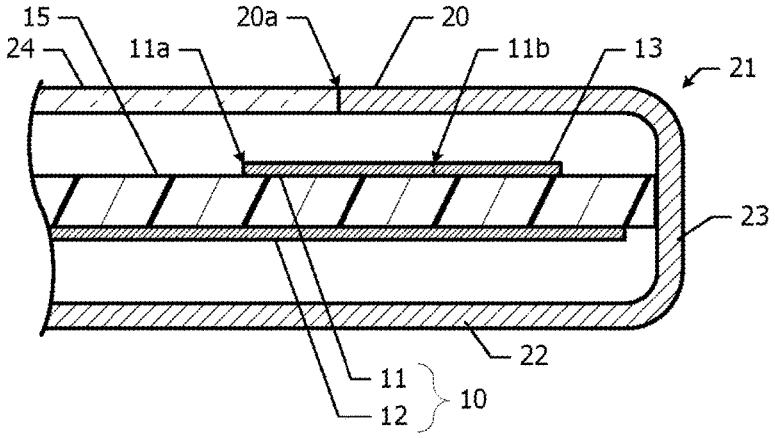
FIG. 1B is a cross-sectional view taken along a dot-dash line 1B-1B in FIG. 1A.

FIG. 1A is a plan view of the antenna device according to the first embodiment, and FIG. 1B is a cross-sectional view taken along a dot-dash line 1B-1B in FIG. 1A. The stated antenna device includes a patch array antenna 10 and a conductive metal member 20. The patch array antenna 10 includes a plurality of radiation elements 11 disposed on an upper surface of a dielectric substrate 15 and a ground plane 12 disposed on a lower surface thereof. The plurality of (e.g., four) radiation elements 11 are arranged in one direction (array direction).

Power is fed to the radiation element 11 through a feed line 13. The feed line 13 and the ground plane 12 configure a transmission line of a microstrip line structure. In an example shown in FIG. 1A, a plurality of feed lines 13 branching from the single feed line 13 are respectively connected to the radiation elements 11. The radiation element 11 is excited in a direction orthogonal to the array direction.

The conductive metal member 20 is disposed above a surface on which the plurality of radiation elements 11 are disposed (the upper surface of the dielectric substrate 15) while being distanced from the radiation elements 11. The metal member 20 overlaps with part of a region of each of the plurality of radiation elements 11 in a direction orthogonal to the array direction of the patch array antenna 10 (in an up-down direction in FIG. 1A) and does not overlap with the other part of the region. In other words, the metal member 20 covers part of the region of each of the radiation elements 11, and blocks part of a cross section of a propagation path of radio waves radiated from the radiation element 11 in a radiation direction (in a normal direction of the dielectric substrate 15). In FIG. 1A, regions of the radiation elements 11 and feed lines 13 that are covered by the metal member 20 are illustrated with broken lines.

The metal member 20 continuously extends from the radiation element 11 at one end to the radiation element 11 at the other end in the array direction. In FIG. 1A, part of the region on a lower side of each of the radiation elements 11 overlaps with the metal member 20.

The metal member 20 overlaps with the overall region of the feed line 13 and covers the feed line 13. The ground plane 12, the metal member 20, and the feed line 13 configure a transmission line of a tri-plate structure.

The patch array antenna 10 is accommodated inside a housing 21 that is partially formed of metal. The metal member 20 configures part of the housing 21. For example, a metal portion of the housing 21 includes a bottom plate 22 facing downward, the metal member 20 facing upward, and an end plate 23 connecting the bottom plate 22 and the metal member 20. In addition, the housing 21 includes a dielectric plate 24 for closing a cavity in the metal portion. The plurality of radiation elements 11 are disposed inside the housing 21 along an end (the end plate 23) of the housing 21.

Next, operations of the antenna device according to the first embodiment will be described. When power is fed to the plurality of radiation elements 11 through the feed lines 13, each of the radiation elements 11 is excited in a direction orthogonal to the array direction. A dimension of the radiation element 11 in the direction orthogonal to the array direction is equivalent to about half the resonance wave length.

A fringing electric field is generated taking each of edges 11*a* and 11*b*, which are respectively positioned on both sides of each radiation element 11 in the direction orthogonal to the array direction, as a start or termination point. By the fringing electric field taking the edge 11*b* positioned on the side covered by the metal member 20 as a start or termination point, a current is excited in the metal member 20 and the fringing electric field is concentrated on a leading-end edge 20*a* of the metal member 20. In the first embodiment shown in FIGS. 1A and 1B, the edge 11*a* of the radiation element 11 positioned on the side not being covered by the metal member 20 and the leading-end edge 20*a* of the metal member 20 become a wave source to radiate radio waves.

Next, an excellent effect obtained by employing the configuration of the antenna device according to the first embodiment will be described below.

In general, a blocking member such as a metal or the like is not disposed in the propagation path of radio waves radiated from the patch array antenna 10 in the radiation direction. However, in the first embodiment, the metal member 20, which is part of the metal portion of the housing 21, is disposed in part of the propagation path of the radio waves radiated in the radiation direction of the patch array antenna 10. As such, the patch array antenna 10 can be stored in the housing 21 even if the cavity in the metal portion of the housing 21 is small. In particular, a compact terminal that is always required to have a larger screen, such as a smart phone or the like, is difficult to secure a large cavity dedicated to its antenna. However, in the first embodiment, because it is possible to miniaturize the cavity that is secured to be dedicated to the antenna, the antenna device according to the first embodiment is suited for being mounted in a compact terminal such as a smart phone or the like.

In the case where it is attempted to dispose the patch array antenna 10 so that the patch array antenna 10 and the metal member 20 do not overlap with each other, the patch array antenna 10 needs to be further distanced from the end plate 23 of the housing 21. In the first embodiment discussed above, because the patch array antenna 10 can be positioned close to the end plate 23 of the housing 21, the efficiency of space usage inside the housing 21 can be enhanced.

Further, in the above-discussed first embodiment, each of the edges 11*a* of the radiation elements 11 and the leading-end edge 20*a* of the metal member 20 function as a wave source. The distribution of the current excited in the metal member 20 changes depending on a geometric shape formed by the plurality of radiation elements 11 and the metal member 20, a relative position relationship therebetween, a dielectric constant of a space between the radiation elements 11 and the metal member 20, or the like. Accordingly, adjusting the position relationship between the radiation elements 11 and the metal member 20, the dielectric constant of the space therebetween, or the like makes it possible to adjust the directivity characteristics of the patch array antenna 10. The directivity characteristics of the patch array antenna 10 will be described later with reference to the drawings of FIG. 3A through FIG. 5B.

Figure 2:
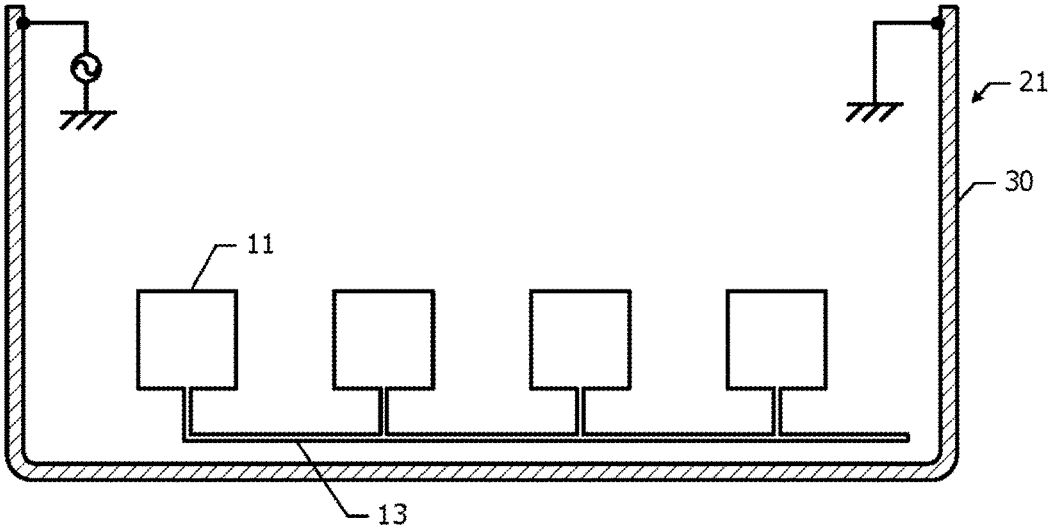
FIG. 2 is a schematic plan view of the antenna device for explaining an effect of the first embodiment.

As shown in FIG. 2, in a smart phone or the like, there is a case in which the metal portion of the housing 21 is used as a radiation element 30 of an antenna for a frequency band lower than an operation frequency band of the patch array antenna 10 (that is, a low frequency band). For example, the patch array antenna 10 is used for an operation frequency band of the WiGig standards (60 GHz band), while the radiation element 30 is used for an operation frequency band of the WiFi standards (5 GHz band, and so on), operation frequency bands of the fourth generation mobile wireless communications standards (4G standards) (2 GHz band, 800 MHz band, and so on) or the like in some cases.

At this time, there is a case in which the feed line 13 undesirably operates as a radiation element of the antenna for the low frequency band due to coupling between the metal portion of the housing 21 and the feed line 13. In the case where radiation from the feed line 13 is generated, antenna gain, directivity characteristics, and the like are deviated from the target characteristics.

In the above-discussed first embodiment, since the feed line 13 is covered by the metal member 20, unwanted radiation from the feed line 13 can be suppressed in the low frequency band.

Next, a relative position relationship between the plurality of radiation elements 11 and the metal member 20 will be described.

In the case where a region of each of the plurality of radiation elements 11 that overlaps with the metal member 20 is excessively large, radio waves are unlikely to be radiated. In order to obtain satisfactory antenna gain, a dimension of the region of each of the plurality of radiation elements 11 overlapping with the metal member 20 can be no more than about half a dimension of the radiation element 11 in the direction orthogonal to the array direction.

In the case where the region of each of the plurality of radiation elements 11 that overlaps with the metal member 20 is excessively small, a substantial effect due to disposing the metal member 20 cannot be obtained. In order to obtain a substantial effect due to employing the configuration in which part of the region of the radiation element 11 is covered by the metal member 20, the dimension of the overlapping portion can be no less than about 1/20 of the dimension of the radiation element 11 in the direction orthogonal to the array direction.

In the case where an interval between the plurality of radiation elements 11 and the metal member 20 is excessively wide, the coupling between the radiation elements 11 and the metal member 20 is weakened so that a current is unlikely to be excited in the metal member 20. In order to obtain an effect of adjusting the directivity characteristics of the patch array antenna 10 by exciting a current in the metal member 20, the interval between the radiation elements 11 and the metal member 20 can be no more than about 1/10 of a free space wave length at the resonant frequency of the patch array antenna 10.

Meanwhile, in the case where the radiation elements 11 and the metal member 20 are positioned excessively close to each other, characteristics of the antenna are degraded. The interval between the radiation elements 11 and the metal member 20 can be no less than about 1/50 of the free space wave length at the resonant frequency of the patch array antenna 10. For example, in the case where the patch array antenna 10 operates in the frequency band of the WiGig standards (60 GHz band), the interval between the radiation elements 11 and the metal member 20 can be no less than about 0.1 mm and no more than about 0.5 mm.

Next, various kinds of variations on the antenna device according to the first embodiment will be described. Although, in the first embodiment, the metal portion of the housing 21 is used as the metal member 20, it is not absolutely necessary for the metal member 20 to be part of the metal portion of the housing. For example, a metal foil attached to an inner surface of a housing made of resin may be used as the metal member 20.

Although, in the above first embodiment, the patch array antenna 10 including four radiation elements 11 is described, the number of radiation elements 11 is not limited to four. It is sufficient for the number of radiation elements 11 to be no less than two. Further, in the first embodiment, although the feed lines 13 branching from the single feed line 13 are respectively connected to the plurality of radiation elements 11, it is also possible to insert a phase shifter in each of the feed lines 13 connected to the radiation elements 11 so as for the antenna to operate as a phased-array antenna.

Although, in the first embodiment, the feed line 13 is connected to an end portion of the radiation element 11, the position of the feeding point may be adjusted. For example, a cut portion may be provided extending from the end portion of the radiation element 11 toward the inner side thereof, and then the feed line 13 may be connected to the leading end of the cut portion. Adjusting the position of the feeding point makes it possible to obtain impedance matching. Further, in the first embodiment, although a direct feeding method in which the feed line 13 is directly connected to the radiation element 11 is employed, an electromagnetic-coupling feeding method may be employed instead.

Next, with reference to FIG. 3A through FIG. 5B, simulation results of the directivity characteristics of the antenna device according to the first embodiment will be described being compared with the directivity characteristics of an antenna device according to a comparative example.

Figure 3A:
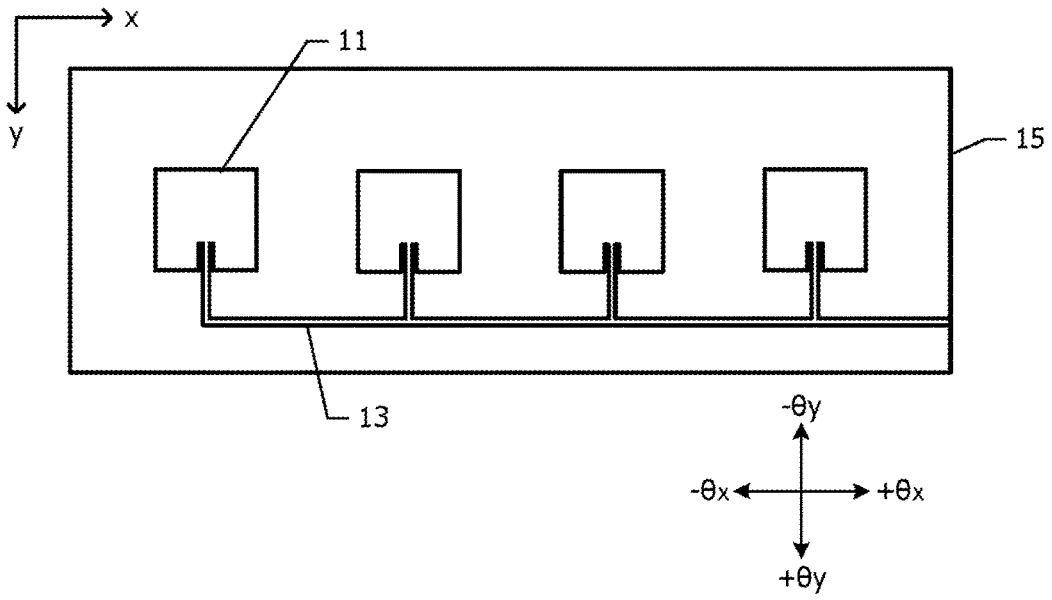
FIG. 3A is a plan view of a simulation model of an antenna device according to a comparative example.
Figure 3B:
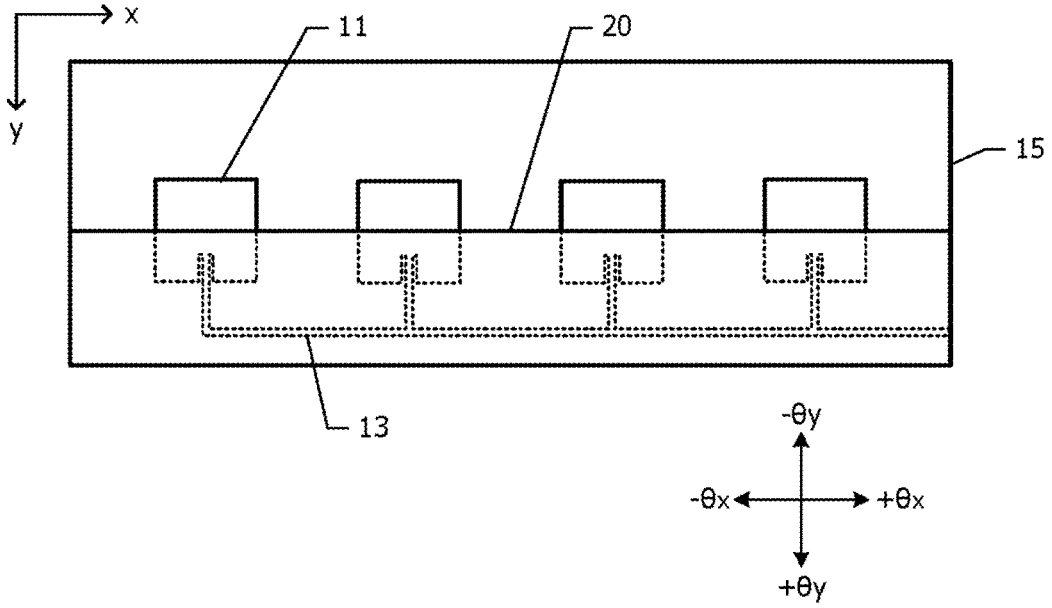
FIG. 3B is a plan view of a simulation model of the antenna device according to the first embodiment.

FIG. 3A is a plan view of a simulation model of the antenna device according to the comparative example, and FIG. 3B is a plan view of a simulation model of the antenna device according to the first embodiment. The configuration of the antenna device according to the comparative example is the same as a configuration in which the metal member 20 is removed from the configuration of the antenna device according to the first embodiment (FIGS. 1A and 1B).

As shown in each of FIGS. 3A and 3B, on the upper surface of the dielectric substrate 15, four radiation elements 11 arranged in a row and the feed line 13 for feeding power to the radiation elements 11 are provided. A cut portion is provided in the end portion of each radiation element 11, and the feed line 13 is connected to the leading end of the cut portion. The ground plane 12 is provided on the lower surface of the dielectric substrate 15 (FIG. 1B). The device is so designed that a high frequency signal has the same phase at the feeding points of the plurality of radiation elements 11. Dimensions of the radiation elements 11 are designed so that the resonant frequency becomes 60 GHz.

Here is defined an xy orthogonal coordinate system in which the array direction is taken as an x direction and a direction orthogonal to the array direction and parallel to the upper surface of the dielectric substrate 15 is taken as a y direction. In the antenna device according to the first embodiment shown in FIG. 3B, a direction facing a region of the radiation element 11 covered by the metal member 20 from a region of the radiation element 11 being not covered by the metal member 20 is defined as a positive orientation of a y-axis. A tilt angle of a direction tilted from a normal direction of the upper surface of the dielectric substrate 15 toward the x direction is represented as θx, while a tilt angle of a direction tilted therefrom toward the y direction is represented as θy.

Figure 4A:
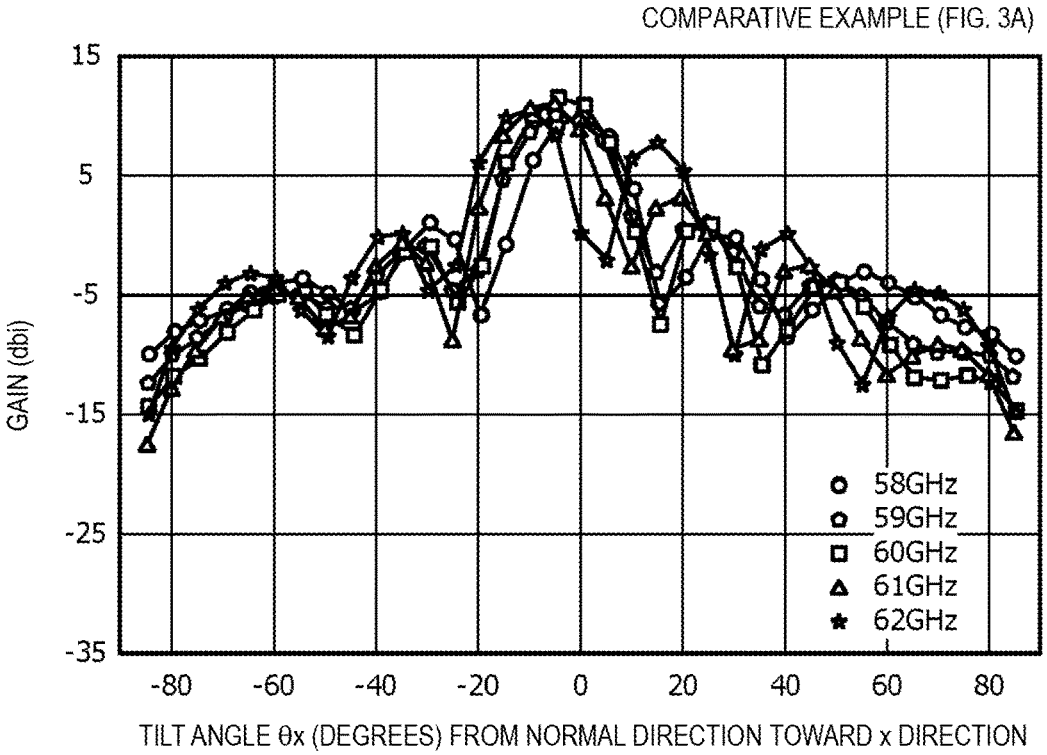
FIGS. 4A and 4B are graphs respectively indicating simulation results of directivity characteristics regarding an x direction and a y direction of the antenna device according to the comparative example shown in FIG. 3A.
Figure 4B:
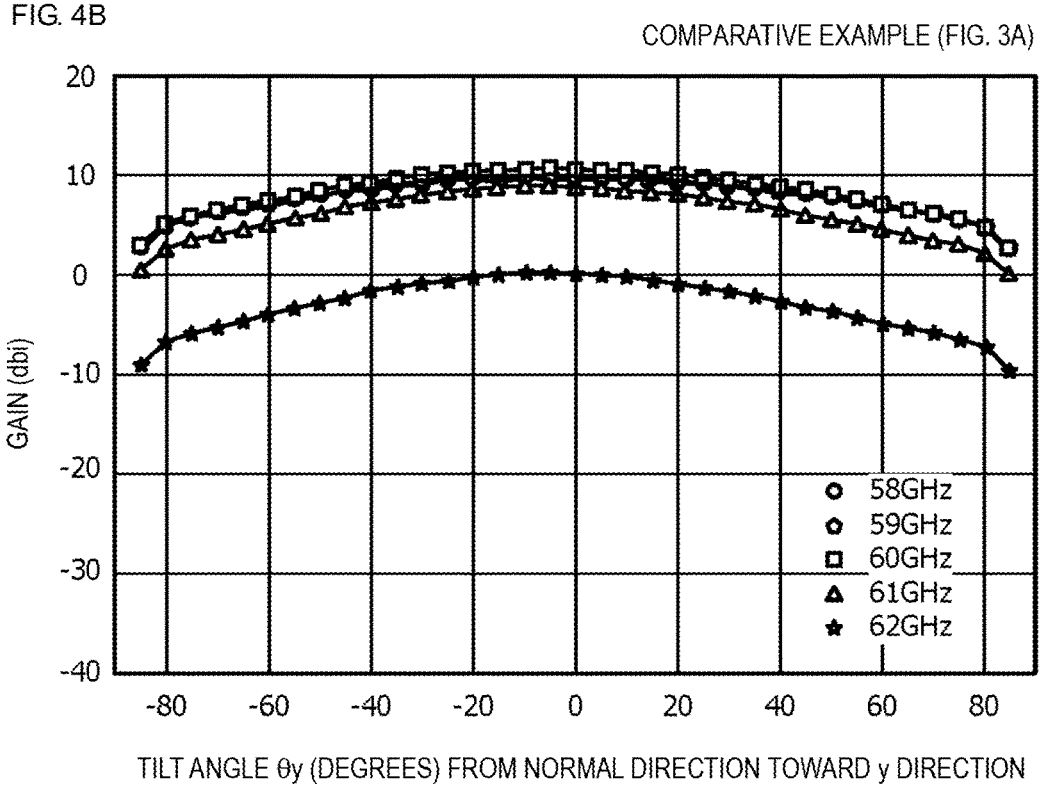
Figure 5A:
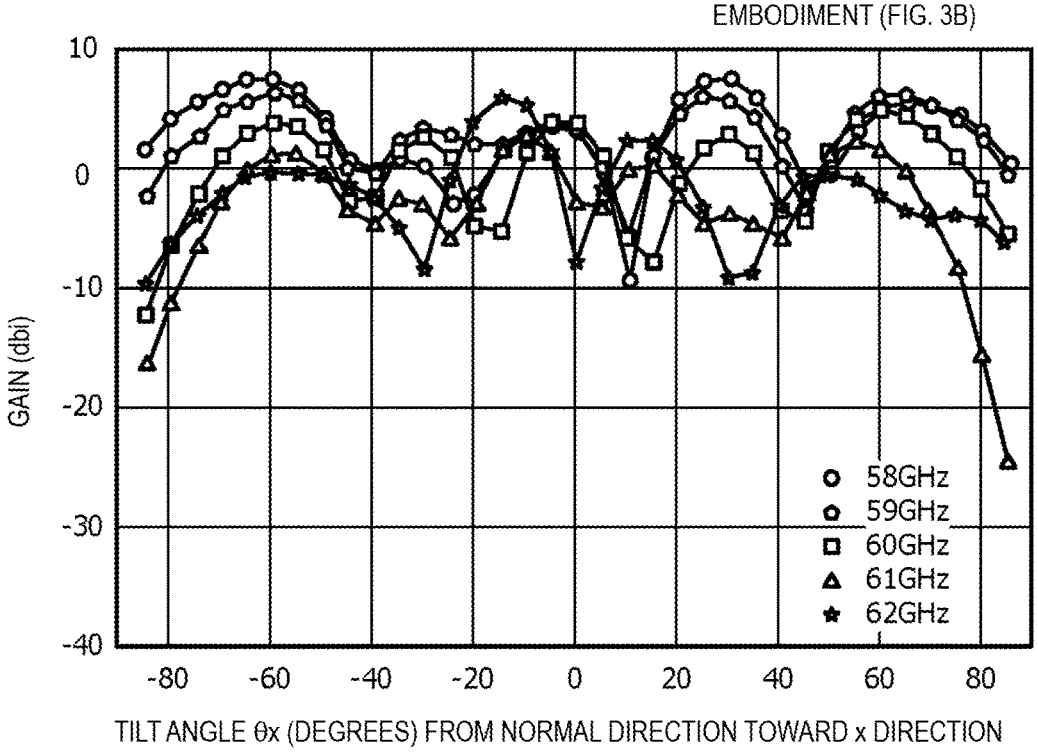
FIGS. 5A and 5B are graphs respectively indicating directivity characteristics regarding an x direction and a y direction of the antenna device according to the first embodiment shown in FIG. 3B.
Figure 5B:
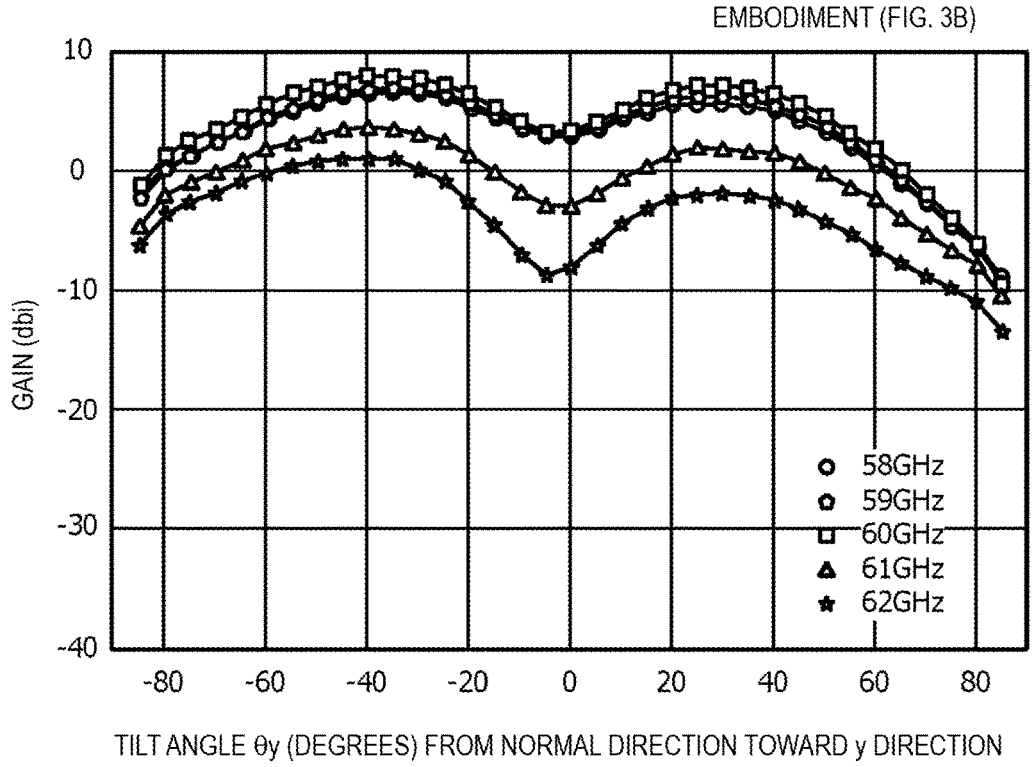

FIGS. 4A and 4B are graphs respectively indicating simulation results of the directivity characteristics regarding the x direction and the y direction of the antenna device according to the comparative example shown in FIG. 3A. FIGS. 5A and 5B are graphs respectively indicating the directivity characteristics regarding the x direction and the y direction of the antenna device according to the first embodiment shown in FIG. 3B. Horizontal axes of FIGS. 4A and 5A each represent the tilt angle θx from the normal direction toward the x direction in units of "degrees". Horizontal axes of FIGS. 4B and 5B each represent the tilt angle θy from the normal direction toward the y direction in units of "degrees". The tilt angles toward positive orientations of the x and y directions are defined as being positive, while the tilt angles toward negative orientations thereof are defined as being negative. In each of the graphs, a vertical axis represents gain in units of "dBi".

In the graphs, symbols of circle, pentagon, square, triangle, and star indicate simulation results at frequencies of 58 GHz, 59 GHz, 60 GHz, 61 GHz, and 62 GHz, respectively.

As shown in FIG. 4A, in the antenna device according to the comparative example, regarding the x direction, a tendency is observed that the gain in the normal direction takes a maximum value, and that the gain becomes smaller as an absolute value of the tilt angle θx becomes larger. Meanwhile, as shown in FIG. 5A, in the antenna device according to the first embodiment, another tendency is observed that the gain is not lessened even when the tilt angle θx toward the x direction becomes large so that the gain is maintained to be substantially constant. As such, the directivity characteristics regarding the x direction can be made substantially non-directional.

Further, as shown in FIG. 4B, in the antenna device according to the comparative example, regarding the y direction, a tendency is observed that the radiation in the normal direction is strongest, and that the gain becomes smaller as an absolute value of the tilt angle θy becomes larger. In the antenna device according to the first embodiment, as shown in FIG. 5B, it is understood that the gain takes maximum values at two directions, that is, a direction in which the tilt angle θy is about −40 degrees and a direction in which the tilt angle θy is about +30 degrees.

Through the simulations discussed above, it has been confirmed that the directivity characteristics of the antenna device can be changed by disposing the metal member 20 (FIG. 3B). The change of the directivity characteristics is caused by an action effect in which the leading-end edge 20*a* of the metal member 20 acts as a wave source due to the distribution of the current excited in the metal member 20. The distribution of the current excited in the metal member 20 depends on a geometric shape formed by the radiation elements 11 and the metal member 20 as well as a relative position relationship therebetween. Accordingly, by adjusting the position relationship between the radiation elements 11 and the metal member 20, the directivity characteristics of the antenna device can be tailored to the desired characteristics.

Next, an antenna device according to a second embodiment will be described with reference to FIG. 6A. Hereinafter, different points from the first embodiment indicated in FIGS. 1A, 1B, and 2 will be described, and description of the same configurations will be omitted.

Figure 6A:
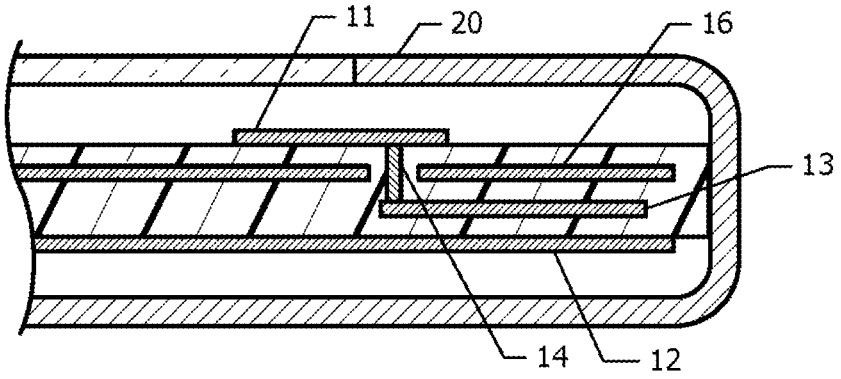
FIG. 6A is a cross-sectional view of an antenna device according to a second embodiment.

FIG. 6A is a cross-sectional view of the antenna device according to the second embodiment. In the first embodiment, a coplanar feeding method in which the radiation element 11 and the feed line 13 are disposed on the same surface (FIG. 1B) is employed. In contrast, the second embodiment employs a rear-surface feeding method in which the feed line 13 is connected to a surface of the radiation element 11 facing downward.

As shown in FIG. 6A, the plurality of radiation elements 11 are provided on the upper surface of the dielectric substrate 15, and the feed line 13 is provided inside the substrate. The feed line 13 is connected to the radiation element 11 with a conductor via 14. A ground plane 16 is disposed between the radiation element 11 on the upper surface and the feed line 13 inside the substrate. The conductor via 14 extends, passing through an opening portion provided in the ground plane 16, from the feed line 13 up to the radiation element 11. A transmission line of a tri-plate structure is formed by the feed line 13, the ground plane 16, and another ground plane 12 provided on the lower surface of the dielectric substrate 15.

Figure 6B:
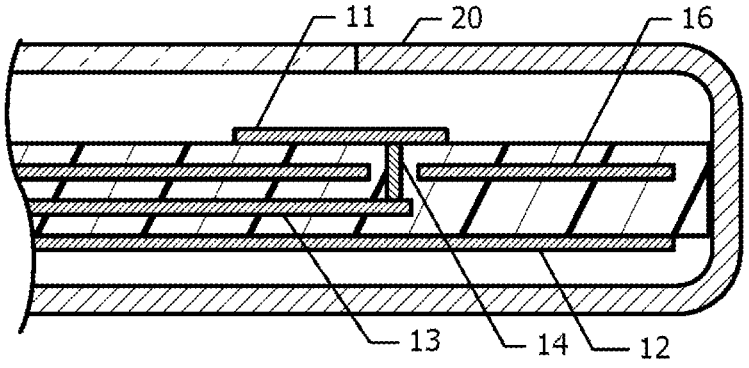
FIG. 6B is a cross-sectional view of an antenna device according to a variation on the second embodiment.

FIG. 6B is a cross-sectional view of an antenna device according to a variation on the second embodiment. In the second embodiment, the feed line 13 extends from the radiation element 11 in a direction toward an edge of the dielectric substrate 15; however, in the variation shown in FIG. 6B, the feed line 13 extends from the radiation element 11 toward an inner depth portion of the dielectric substrate 15.

Also in the second embodiment and the variation on the second embodiment, the metal member 20 covers part of a region of each of the plurality of radiation elements 11. Because of this, the same effect as that of the first embodiment can be obtained. Further, since the feed line 13 forms the transmission line of the tri-plate structure, the coupling between the feed line 13 and the radiation element 30 of the antenna for a low frequency band, as shown in FIG. 2, can be reduced.

It goes without saying that the above-described embodiments are merely examples, and that configurations described in different embodiments can partly replace each other or be combined as well. Same action effects brought by the same configurations in the plurality of embodiments are not successively described in each of the embodiments. Further, the present invention is not limited to the above-described embodiments. For example, it will be apparent to those skilled in the art that various kinds of changes, improvements, combinations, and so on can be carried out.

While preferred embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. An antenna device comprising:

a patch array antenna including a ground plane and a plurality of radiation elements that are disposed being distanced from the ground plane; and a conductive metal member that is disposed above a surface on which the plurality of radiation elements are disposed, the conductive metal member overlaps with part of a region of each of the plurality of radiation elements in a direction orthogonal to an array direction of the patch array antenna and does not overlap with the other part of the region, and the conductive metal member extends from one of the plurality of radiation elements at one end to one of the plurality of radiation elements at the other end in the array direction.

2. The antenna device according to claim 1, wherein a dimension of the region of each of the plurality of radiation elements overlapping with the conductive metal member is no more than about a half of a dimension of the radiation element in the direction orthogonal to the array direction.

3. The antenna device according to claim 1, wherein an interval between the radiation element and the conductive metal member is about 1/50 or more and about 1/10 or less of a free space wave length that corresponds to a resonant frequency of the patch array antenna.

4. The antenna device according to claim 1, further comprising:

a feed line having a microstrip line structure to feed power to the plurality of radiation elements, wherein the feed line overlaps with the conductive metal member and is disposed between the ground plane and the conductive metal member.

5. The antenna device according to claim 1, further comprising:

a housing comprising metal, the housing accommodating the patch array antenna, wherein the conductive metal member configures part of the housing.

6. The antenna device according to claim 5, wherein the plurality of radiation elements are disposed inside the housing along an end of the housing.

7. The antenna device according to claim 1, wherein an interval between the radiation element and the conductive metal member is about 1/50 or more and about 1/10 or less of a free space wave length that corresponds to a resonant frequency of the patch array antenna.

8. The antenna device according to claim 2, further comprising:

a feed line having a microstrip line structure to feed power to the plurality of radiation elements, wherein the feed line overlaps with the conductive metal member and is disposed between the ground plane and the conductive metal member.

9. The antenna device according to claim 3, further comprising:

a feed line having a microstrip line structure to feed power to the plurality of radiation elements, wherein the feed line overlaps with the conductive metal member and is disposed between the ground plane and the conductive metal member.

10. The antenna device according to claim 2, further comprising:

a housing comprising metal, the housing accommodating the patch array antenna, wherein the conductive metal member configures part of the housing.

11. The antenna device according to claim 3, further comprising:

a housing comprising metal, the housing accommodating the patch array antenna, wherein the conductive metal member configures part of the housing.

12. The antenna device according to claim 4, further comprising:

a housing comprising metal, the housing accommodating the patch array antenna, wherein the conductive metal member configures part of the housing.

* * * * *